US006106370A

United States Patent [19]

Carter

[11] Patent Number: 6,106,370

[45] Date of Patent: Aug. 22, 2000

[54] PIPE CLEANING AND BURNISHING TOOL AND METHOD

[76] Inventor: Sam W. Carter, 4170 Indian Hills Tr., West Branch, Mich. 48661

[21] Appl. No.: 09/059,833

[22] Filed: Apr. 14, 1998

Related U.S. Application Data

[60] Provisional application No. 60/043,319, Apr. 15, 1997.

[51] Int. Cl.[7] ..... B24B 1/00

[52] U.S. Cl. ..... 451/51; 451/440; 451/465; 451/484; 451/486; 7/157

[58] Field of Search ..... 451/510, 415, 451/464, 465, 484, 485, 486, 357, 461, 462, 440, 441, 51; 7/157

[56] References Cited

U.S. PATENT DOCUMENTS

| | | | |
|---|---|---|---|
| 2,812,624 | 11/1957 | Billeter | 451/485 |
| 3,568,376 | 3/1971 | Slater | 451/486 |
| 4,246,728 | 1/1981 | Leasher | 451/440 |
| 4,955,165 | 9/1990 | Brooks et al. | 451/485 |
| 5,058,327 | 10/1991 | Buchanan | 451/462 |
| 5,168,660 | 12/1992 | Smith | 451/462 |
| 5,269,104 | 12/1993 | DiBiagio | 451/461 |
| 5,613,896 | 3/1997 | Haus et al. | 451/50 |

*Primary Examiner*—M. Rachuba

*Attorney, Agent, or Firm*—Reising, Ethington, Barnes, Kisselle, Learman & McCulloch, P.C.

[57] ABSTRACT

The pipe cleaner attachment includes a housing, a shuttle, and a shuttle guide. The housing has a closed end, an open end, a key and two brush levers and brush pad guide slots. The shuttle guide is a rod clamped in a bore through the closed end of the housing. The end of the rod outside the housing is clamped in a drill chuck for use. The shuttle is slideably mounted in the housing on the shuttle guide and engages the housing key, A pair of brush levers are pivotally mounted in the brush guide slots. A brush pad is attached to an end of each brush lever. Burnishing grooves are provided in the shuttle for burnishing the open ends of pipes with two different diameters. Upon insertion of a pipe into the housing, the pipe end is reamed, the burnishing grooves burnish the pipe end, the shuttle is moved toward the closed end and the brush pads clean the outside surfaces of the pipe.

7 Claims, 5 Drawing Sheets

FIG-4
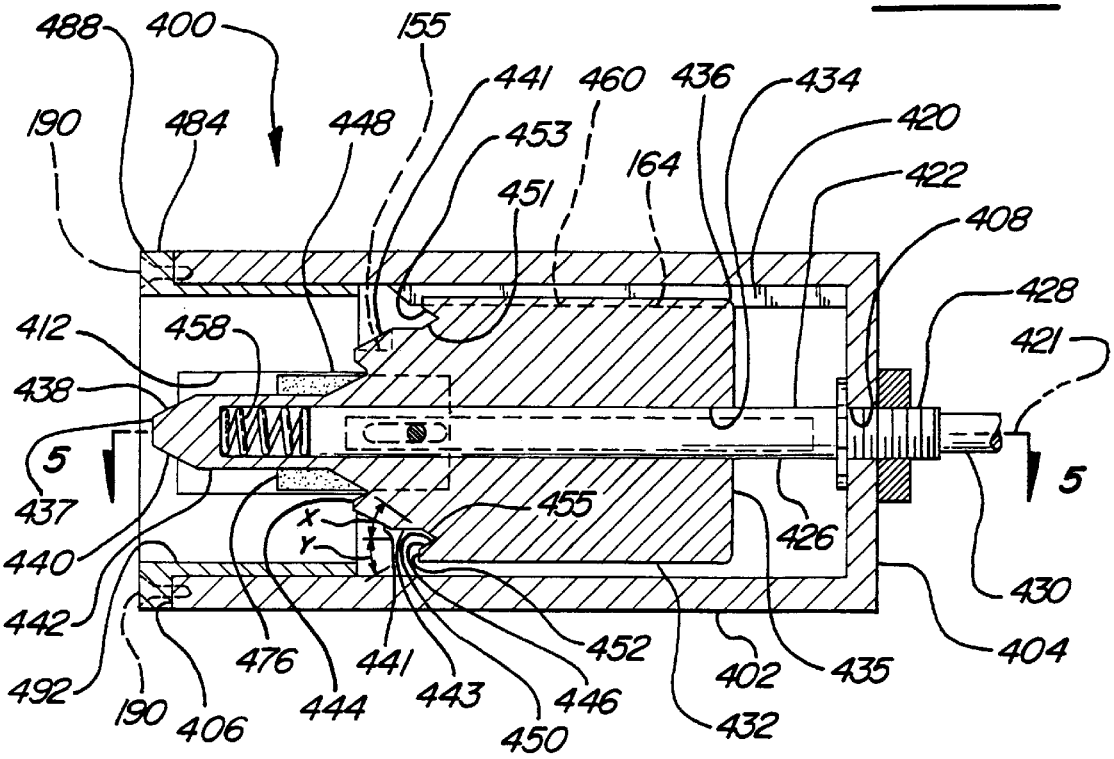
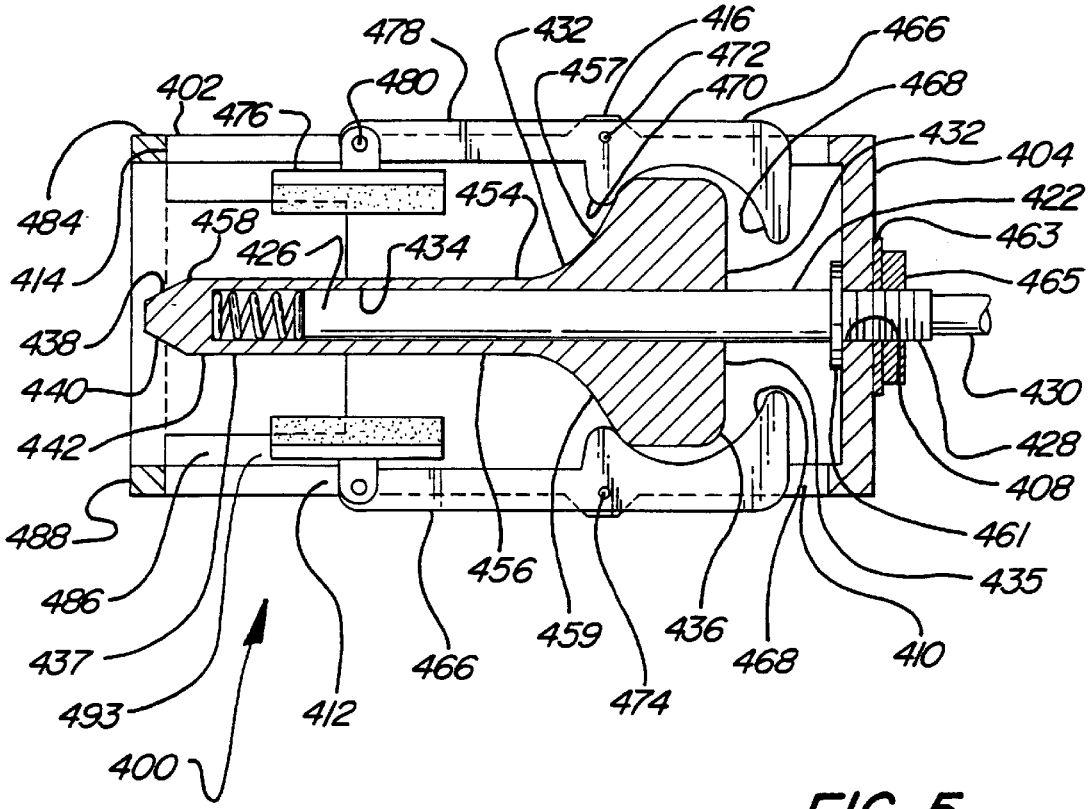
FIG-5

FIG-7
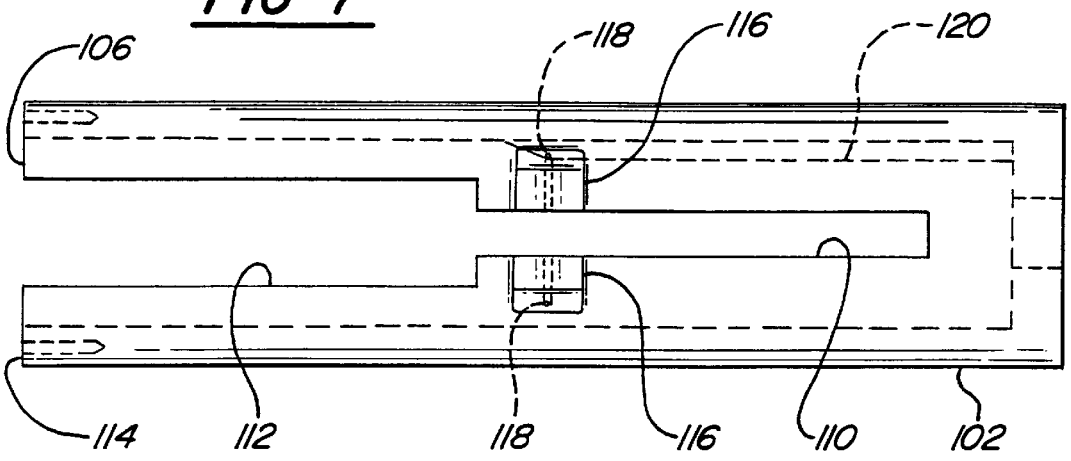
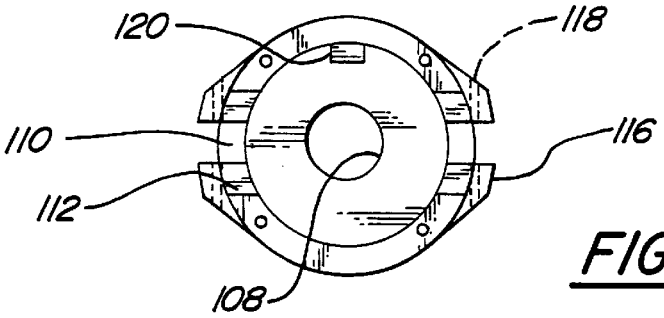
FIG-8
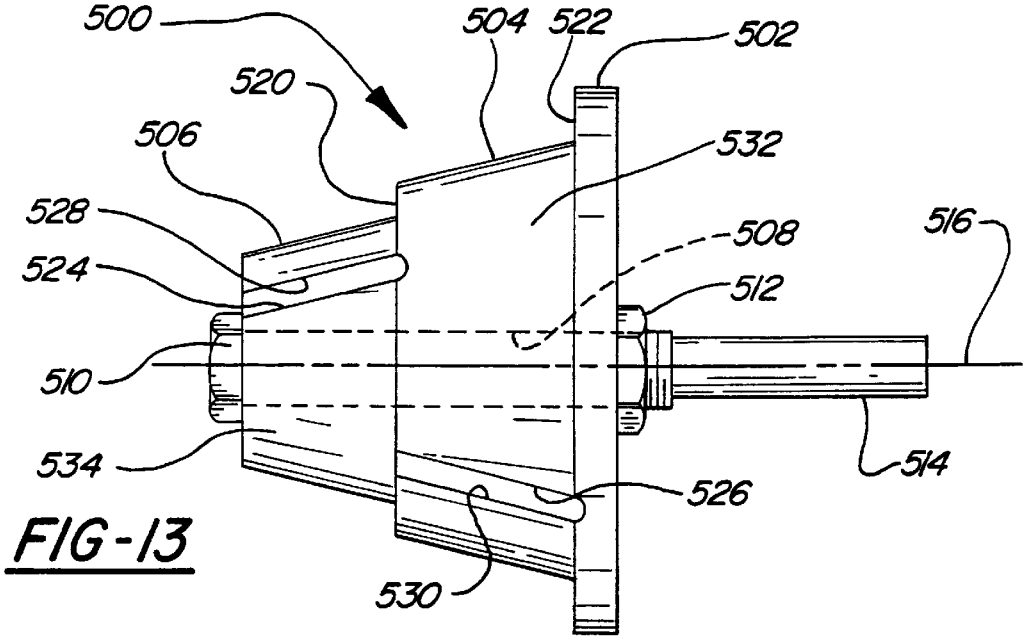
FIG-13

PIPE CLEANING AND BURNISHING TOOL AND METHOD

This application claims benefit of Ser. No. 60/043,319 filed Apr. 15, 1997.

TECHNICAL FIELD

This invention is in a copper pipe cleaning tool, and more particularly in a copper pipe cleaning tool in combination with an abrading tool driven by an electric drill that cleans and polishes the outside surface of an end of a pipe and removes burrs and sharp edges from the end surface of the pipe in preparation for connecting the pipe to a coupling with solder.

BACKGROUND OF THE INVENTION

The ends of copper pipe are usually cleaned manually with an abrasive such as steel wool or emery cloth. The abrasive is held in contact with the surface to be cleaned with one hand, and the other hand oscillates the pipe back and forth about the central axis. This is a slow process, and can strain hand and arm muscles.

The ends of copper pipe have been cleaned by wire brushes on the spindles of electric grinders to reduce muscle strain and save time. These wire brush cleaners are difficult to control. Some areas are not adequately cleaned while excess material is removed from other areas. Joints that leak or that are weakened result from cleaning with rotating wire brushes.

Power tools that employ emery cloth belts have also been employed. These belts tend to have a short life because their abrasive surfaces will fill with metal particles, and they stop cleaning and polishing. Short belt life tends to make these power tools expensive to operate. Vibrations due to the serpentine belt path is another problem with these power tools. The vibrations damage the tool, the electric drill that drives the tool, and tire the operator.

A pipe that has been cut by a pipe cutter with two rollers and a cutter disk have ends with a reduced inside diameter and a sharp edge. Hand reamers have been used to remove the sharp edge and increase the diameter. In most cases, the inside diameter is not increased to the original inside diameter of the pipe due to the time and effort required to operate the hand reamer.

A pipe that has been cut by a saw has sharp edges and burrs that interfere with pipe joints. These burrs and sharp edge have been removed in two separate steps. A reamer or a round file have been used to remove inside burrs and sharp edges. A flat file or grinder stone has been used to remove outside burrs.

The various power tools, for cleaning the outer surface of a pipe adjacent to an end of the pipe and removing the burrs, have been unsuccessful due to the problems mentioned above and to other problems.

SUMMARY OF THE INVENTION

An object of the invention is to provide a rotary power tool for cleaning a pipe in preparation for soldering.

Another object of the invention is to provide a rotary power tool for cleaning pipe that is balanced.

A further object of the invention is to provide a rotary power tool for cleaning pipe that has replaceable abrasive members.

A still further object of the invention is to provide a rotary power tool for cleaning a pipe that permits the operator to control pressure applied to the pipe by the abrasive members.

A yet still further object of the invention is to provide a rotary power tool for cleaning pipe that encloses the working parts in a housing.

Another further object of the invention is to provide a burnishing tool that removes burrs and sharp edges from the end of a pipe.

A rotary power tool for cleaning and polishing a copper pipe as well as pipe made from other materials includes a base plate with a central aperture. A shaft, with four sections having different diameters, a common central axis and three steps has a small end inserted through the central aperture and seats on the base plate with the second step against a first side of the base plate. A nut slides over the small diameter first section of the shaft and screws onto the threaded second section of the shaft. The nut is tightened to clamp the base plate in a fixed position on the shaft.

A bushing with a collar is slidably mounted on the third section of the shaft. The bushing is free to slide along the third section of the shaft between the base plate and the step which separates the third section of the shaft from the fourth section. The fourth section of the shaft is a pilot shaft that guides a copper pipe into and out of the cleaning and polishing tool. The small diameter first end of the shaft is receivable in the chuck of an electric drill that rotates the shaft and the base plate.

Two or more channel shaped pad retainers are secured to the first side of the base plate with an open side of the channel facing toward the shaft. An L-shaped bell crank is pivotally attached to each channel shaped pad retainer, and is pivoted about an axis in a plane that is transverse to the axis of the shaft. A leg of the bell crank, that extends radially inward from the bell crank pivot toward the shaft has a free end positioned between the base plate and the bushing collar. Another leg of the bell crank extends from the bell crank pivot away from the base plate and generally parallel to the axis of the shaft. An abrasive pad and pad holder is pivotally attached to the other leg of the bell crank. The abrasive pad is preferably a non-woven nylon material with an abrasive bonded to it. The pad is bonded to the pad holder and is positioned between the pad holder and the shaft.

The channel shaped pad retainers are spaced 180° apart about the axis of the shaft, when two pad retainers are used, to balance the tool. If three pad retainers are employed, they are spaced 120° apart. Four pad retainer spaced 90° apart could also be employed if desired. However, four pad retainers could be balanced with other spacing.

A cover is attached to the base. The cover enclosed the channel shaped pad retainers except for an aperture that the fourth section of the shaft extends through. The aperture is larger in diameter than the shaft to permit the end of a pipe to be inserted into the cover guided by the fourth section of the shaft.

An alternate form of the invention includes a housing that is rotatable about an axis and guides a shuttle along a path parallel to the axis of rotation. The shuttle is urged toward a stop by an external compression spring.

A further alternate construction is similar to the alternate construction but has an internal spring that urges the shuttle toward a pipe entry. Axial movement of the shuttle is limited by the bell crank.

A reamer for reaming the inside surface of the end of a pipe can be on an integral part of the pipe cleaner or it can be a separate tool. A burnishing tool for removing burrs and smoothing the end of a pipe can also be an integral part of the pipe cleaner or it can be a separate tool.

BRIEF DESCRIPTION OF THE DRAWINGS

The presently preferred embodiment of the invention is disclosed in the following description and in the accompanying drawings, wherein:

FIG. 4 is a cross sectional view of a further alternate pipe cleaner with an internal spring, an inside pipe reamer and a pipe end burnisher;

FIG. 5 is a cross sectional view taken along line 5—5 in FIG. 4;

FIG. 7 is a side view of the housing of FIG. 3;

FIG. 8 is an end view of the open end of the housing of FIG. 7

FIG. 13 is a side view of a pipe reamer.

DESCRIPTION OF THE PREFERRED EMBODIMENTS

Figure 2:
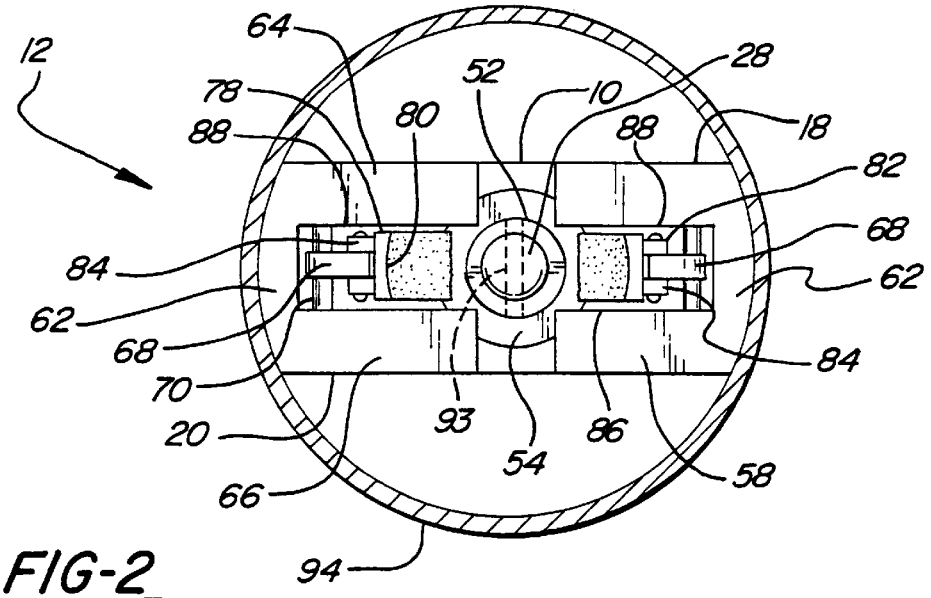
FIG. 2 is a sectional view taken along line 2—2 in FIG. 1.
Figure 1:
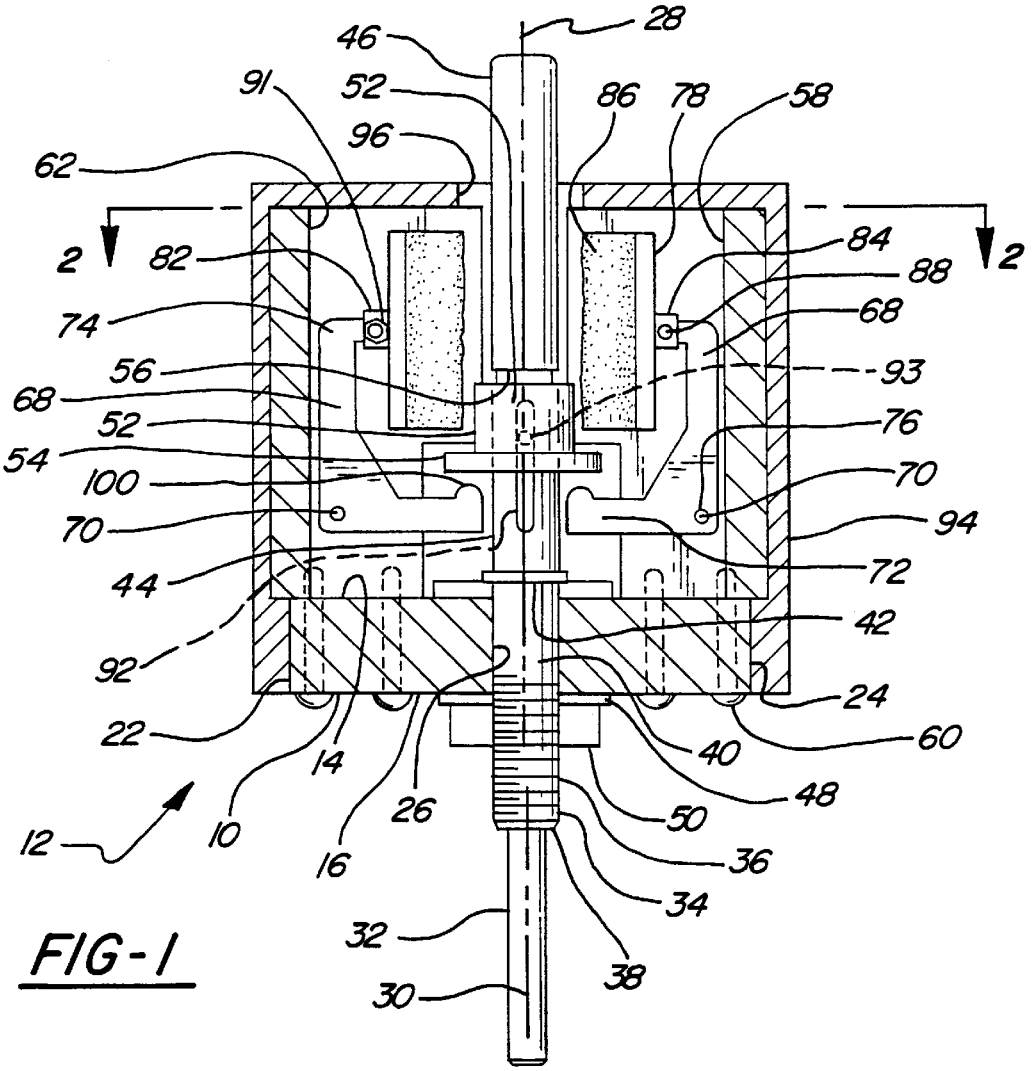
FIG. 1 is a cross sectional view of a pipe cleaner with centrifugal force operation.

The base plate 10 of a rotary power tool 12, for cleaning and polishing a pipe, has an upper surface 14, a lower surface 16, side edges 18 and 20 and end edges 22 and 24, as shown in FIG. 1 and 2. The base plate 10 can be circular rather then rectangular, as shown in the drawings, if desired. A central bore 26 is provided in the base plate 10.

A shaft 28, as shown in FIG. 2, has four sections with different diameters and a common axis 30. The first section 32 has the smallest diameter, and during use is clamped in the chuck of an electric drill. The second section 34 has a threaded portion 36 adjacent to the first step 38 and a non-threaded portion 40 adjacent to the second step 42. A third section 44 is a sliding bushing guide. The fourth section 46 is a pilot shaft for guiding a pipe into and out of the tool 12.

The first and second sections 32 and 34 of the shaft 28 are inserted into the central bore 26 through the base plate 10 until the second step 42 contacts the upper surface 14 of the base plate. A washer 48 is placed on the threaded portion 36 and a nut 50 is screwed onto the threaded portion. The shaft 28 is locked in a fixed position relative to the base plate 10 by tightening the nut 50. A key can be provided if needed, to prevent rotation of the shaft 28 relative to the base plate 10.

A bushing 52 with a collar 54, shown in FIGS. 1 and 2, is placed on the third section 44 of the shaft 28 before the shaft is inserted into the central bore 26 of the base plate 10. This bushing 52 is free to slide along the length of the bushing guide between the base plate 10 and the third step 56, between the third section 44 and the fourth section 46. The bushing 52 is also free to rotate on the shaft 28.

Two channel shaped pad retainers 58 are secured to the base plate 10 by mechanical fasteners 60 that pass through bores through the base plate. The bight portion 62 of the retainers 58 are adjacent to the end edges 22 and 24 of the base plate 12. The open side of the channel defined by the free ends of the wall section 64 and 66 faces radially inward toward the shaft 28.

L-shaped bell cranks 68 are pivotally secured to each of the retainers 58 by pivot pins 70. Each bell crank 68 has a radially extending base leg 72 that extends radially inward toward the shaft 28 and an integral upright leg 74 that extends away from the base plate 10 and generally parallel to the shaft 28. The pivot pin 70 passes through a pivot pin bore 76 through a portion of the bell crank 68 where the base leg 72 and the upright leg 74 are joined. Each pivot pin 70 is held by a pad retainer 58 in a position in which its axis is in a plane that is parallel to the upper surface 14 of the base plate 10 and perpendicular to the axis 30 of the shaft 28. The axis of each pivot pin 70 is also in a plane that is tangent to a cylinder concentric with the shaft 28.

The free end of the base leg 72 of each of the bell cranks 68 is positioned between the upper surface 14 of the base plate 10 and the collar 54 of the bushing 52.

The pad holder 78 is shown in FIGS. 1 and 2. The holder 78 has a generally rectangular shape with a trough shaped surface 80 on one side and two attaching ears 82 and 84 on the opposite side. A non-woven nylon pad 86 coated with an aluminum oxide abrasive is secured to the trough shaped surface 80 by an adhesive. These pads 86 have been found to work well. However, there are other abrasive pads that could be used. The pad holders 78 with attached pads 86 are each attached to the free end of an upright leg 74 of a bell crank 68 by a bolt 88 that passes through the ear 82, through a bore, through the bell crank 68, and through the ear 84. The bolt 88 is retained in place by a nut 91. Preferably, the pad holders 78 can pivot freely about the axis of the bolt 88 within limits.

A shaft 28 that does not have a step 56 to limit axial movement of the bushing 52 along the axis 30 of the shaft, can employ a pin 93 that passes through the bushing 52 and through a slot 92 through the shaft 28 to limit axial movement of the bushing relative to the shaft. If the shaft 28 has the third step 56, the pin 93 and the slot 92 are not used.

A cup shaped cover 94 with a pipe entry aperture 96 encloses the abrasive pads 86 and the pad holders 78 and is secured to the base plate 10. The cover 94 can be released from the base plate 10 and removed to replace worn pads 86 and to clean and maintain the tool 12.

In operation, the first section 32 of the shaft 28 is inserted into the chuck of an electric drill and the chuck is tightened. The drill is turned on, and centrifugal force forces the pad holders 78 radially outward into the channels of the pad retainers 58, thereby freeing the pipe entry passage 96 for insertion of a pipe. A pipe is then inserted over the pilot shaft fourth section 46 of the shaft 28 and guided into the tool 12. The pipe contacts the bushing 52 after the pipe is inserted to at least the third step 56. The bushing 52 may rotate relative to the pipe. The bushing 52 can also rotate on the sliding bushing guide third section 44 of the shaft 28., and on the bearing surfaces 100 of the bell cranks 68. If a pin 93, described above, passes through the bushing 52 and through a slot 92 of the shaft 28, the bushing cannot rotate relative to the shaft, and the bushing will rotate relative to the pipe. Continued insertion of the pipe will move the bushing 52 toward the base plate 10. The collar 54 on the bushing 52 will pivot the bell cranks 68 about the pivot pins 70 and move the pads 86 into contact with the pipe. As the pads 86 rotate around the pipe, they clean and polish the pipe. The pad holders 78 pivot about the axis of the bolts 88 to insure that a band around an end of the pipe is cleaned and polished. The force urging the pads 86 into contact with the pipe is proportional to the force urging the pipe and the bushing 52 into contact with each other. This force is controlled by the operator of the tool 12. After the end of the pipe is cleaned and polished, it is removed from the tool 12.

The pilot shaft section 46 must fit the pipe that is being cleaned and polished to insure proper alignment between the pipe and the pads 86. A tool 12 will therefore normally be used for one size pipe only. There is a tool for ½ inch pipe, and another tool for ¾ inch pipe, for example. However, it will be possible to provide a tool 12 with a shaft 28 that has a changeable pilot shaft 46.

The tool 12 as described above has two abrasive pads 86. When cleaning small diameter pipe, two pads 86 are sufficient. With larger diameter pipe, three pads 86 four pads or even more pads may be employed to reduce cleaning time and to increase the number of pipe ends that are cleaned between replacement of worn pads.

Figure 3:
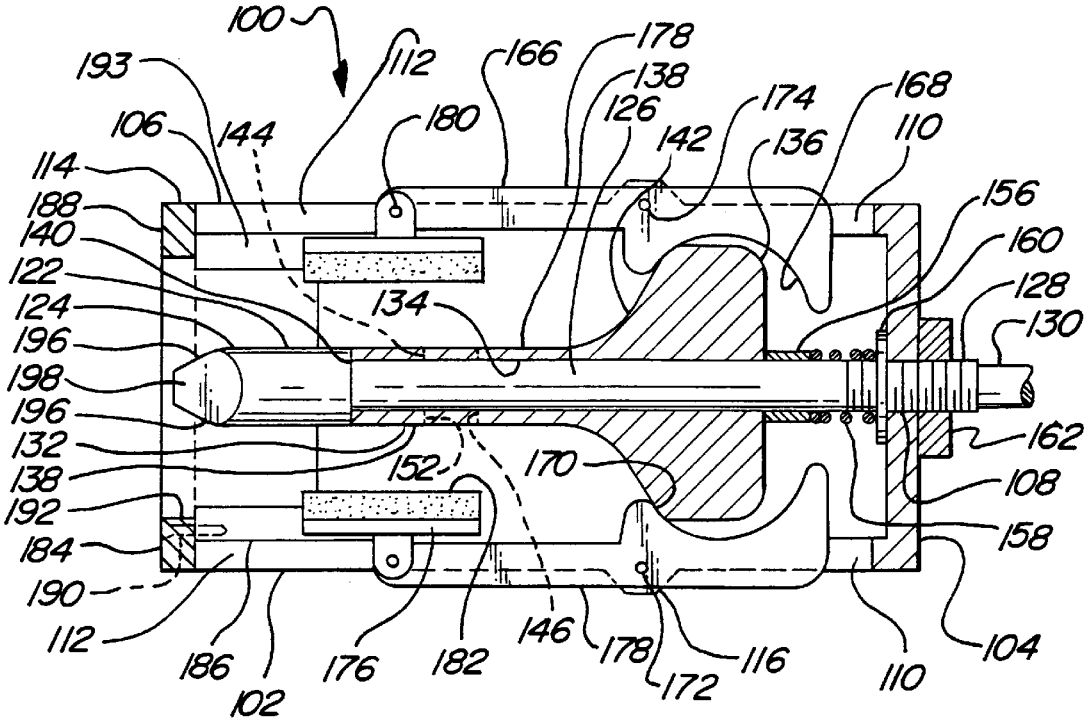
FIG. 3 is a cross sectional view of an alternate pipe cleaner with a shuttle stop, an external spring, an inside pipe reamer and a pipe end burnisher.
Figure 6:
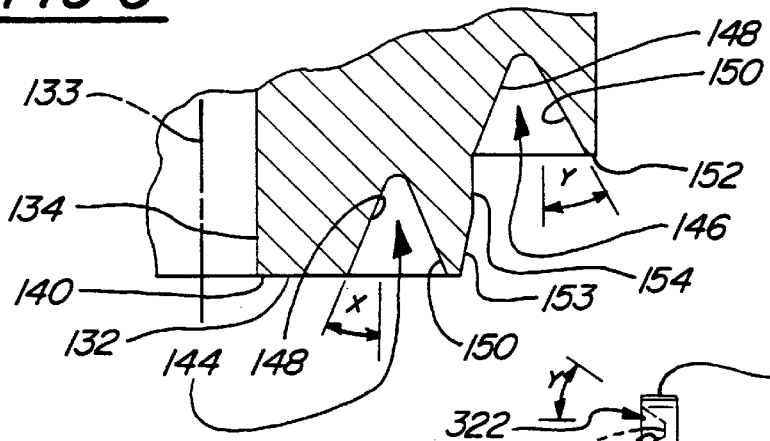
FIG. 6 is an enlarged sectional view, with parts broken away, of the shuttle burnishing grooves of the shuttle shown in FIG. 3.

A combination pipe cleaner and burnishing tool is disclosed in FIGS. 3 and 6. The pipe cleaner 100 functions substantially the same as the tool 12 described above, but has different structure. The different structure permits the pipe cleaner 100 to smooth and bevel the end surfaces of a pipe as well as cleaning the walls of a pipe adjacent to the pipe end. The modified structure also permits the pipe cleaner 100 to clean pipes with two different pipe diameters without changing any parts. The pipe cleaner 100 includes a tubular barrel 102 with a closed end 104 and an open end 106. The closed end 104 has a centered bore 108. A pair of brush lever slots 110 and a pair of brush pad guide slots 112 are formed in opposite sides of the tubular barrel 102. The brush lever slots 110 extend from a position near the closed end 104 to a position about midway between the closed end 104 and the open end 106. The brush pad guide slots 112 join the brush lever slots 110 in the mid portion of the tubular barrel 102 and extend through the end surface 114 of the open end 106. Brush lever pin supports 116 are provided on each side of each brush lever slot 110 adjacent to the brush pad guide slots 112. Brush lever pin bores 118 are provided in the brush lever pin supports 116. A shuttle key 120 is also formed in the tubular barrel 102. The key 120 is integral with the tubular barrel 102 and parallel to the long axis of the barrel.

The pipe guide 122 has a pipe guide portion 124, a shuttle guide portion 126, a threaded portion 128, and a small diameter end portion 130 that is clamped in the chuck of an electric drill during use.

The shuttle 132 is a cylindrical member with a central bore 134. The first end of the shuttle 132 has a first arcuate cam surface 136. The second end of the shuttle 132 has a pair of flat surfaces 138 that extend from the second end surface 140 parallel to the central bore 134 to a second arcuate cam surface 142.

The second end of the shuttle 132 has two pipe end surface burnishing grooves 144 and 146. The inner groove 144 is in two sections and has a diameter that corresponds to the diameter of the smallest pipe that the pipe cleaner 100 can clean. The outer groove 146 is also in two sections and has a diameter that corresponds to the diameter of a larger pipe that the pipe cleaner 100 can clean. The grooves 144 and 146 have a generally V-shaped cross section with the radially inner wall 148 extending at an angle X of about 15 degrees, plus or minus 5 degrees, from the axis 133 of the central bore 134 and the radially outer wall 150 extending at an angle Y between about 17 degrees and about 47 degrees, from the axis of the central bore. The inner groove 144 is on the very end of the shuttle 132. The outer groove 146 is in a surface 152 that is axially spaced from the inner groove 144 toward the cam surface 136 and cam surfaces 142 to provide a guide surface 154 that centers the larger diameter pipes. The guide surface 154 is separated from the end surface by a surface that has reamer edges 153. The reamer edges 153 are formed by flat surfaces 138 and axially extending grooves 155 that are machined into one side the inner groove 144.

The pipe guide 122 is inserted into the central bore 134 of the shuttle 132 until the second end 140 of the shuttle 132 is adjacent to the pipe guide portion 124 and held by the pipe guide portion. A spacer 156 is placed on the shuttle guide portion 126 and a compression spring 158 is inserted over the guide portion. The spacer 156 keeps the spring 158 spaced from the shuttle 132 and prevent damage to the spring due to contact with the brush levers 166. A nut 160 is screwed onto the threaded portion 128 of the pipe guide 122 leaving space for the shuttle 132 to slide on the pipe guide portion 124. The nut 160 also preloads the spring 158. The pipe guide 122 is then inserted into the tubular barrel 102 through the guide bore 108. The key 120 in the tubular barrel 102 enters a keyway 164 in the shuttle 132 and prevents rotation of the shuttle relative to the pipe guide 122 and the barrel. The keyway 164 is identical to the guide slot 460 shown in FIG. 4. A second nut 162 is screwed onto the threaded portion 128 and clamps the closed end 104 against the nut 160.

Brush levers 166 are inserted into each of the brush lever slots 110 with a first cam surface 168 adjacent to the first arcuate cam surface 136 on the shuttle 132 and a second cam surface 170 adjacent to one of the second arcuate cam surfaces 142 on the shuttle. A brush lever pin 172 is inserted into the brush lever pin bores 118 for each brush lever 166 and through a bore 174 through each of the brush levers. A brush pad 176 is inserted into each brush pad guide slot 112 and connected to the brush arm 178 of the adjacent brush lever 166. The connection of the brush pads 176 to the brush lever 166 can be by a brush pin 180 that passes through a bore through the brush lever or by another suitable connector. Abrasive pads 182 are attached to the brush pads 176.

The brush pads 176 are essentially the same as the pads 86 and the pad holders 78 described above. There can be two or more brush pads 176 as explained above depending on the diameter of the pipe being cleaned.

A pipe guide end cap 184 has a cylindrical portion 186 with an outside surface that is received within the open end 106 of the tubular barrel 102. An integral flange 188 on the end cap 184 is clamped to the open end 106 of the tubular barrel 102 by screws 190. A bore 192 through the end cap 184 is slightly larger than the outside diameter of the largest pipe that is to be cleaned and acts as a pipe guide. Brush pad guide slots 193 through the cylindrical portion 186 line up with the brush pad guide slots 112 and guide the brush pads 176 during their movement toward and away from the flat surfaces 138 on the shuttle 132. The flat surfaces 138 on the shuttle 132 allow the brush pads 176 to move into and out of contact with a pipe to be cleaned without contacting the shuttle 132.

Small diameter pipes are stacked on top of each other after they exit an extrusion die. Steel bands secure groups of pipes together in bundles for storage and transport. During transport, straps secure stacked bundles of pipes to hold them on a vehicle bed. As a result, the pipes are frequently deformed slightly. The ends of pipes are also slightly deformed when they are cut by a conventional pipe cutter with two rollers and a cutter disk as the cutter disk is advanced toward the rollers and into contact with the pipe. The slight deformation frequently prevents the end of a pipe from sliding over the pipe guide. This problem can be corrected by providing reamer edges 196 on the free end of the pipe guide portion 124 of the pipe guide 122 that enters the end of the pipe before the pipe telescopically receives the pipe guide portion. The rotating reamer edges 196 remove inside burrs and sharp edges and tend to force the pipe end back into a cylindrical shape. The reamer surfaces 196 as shown in FIG. 3 are formed at the junction of four angled flat surfaces 198 that form a truncated pyramid on the end of the pipe guide 122.

The reduced inside diameter problem, caused by pipe cutter and pipe damage when cleaning the largest diameter pipes the combined pipe cleaner and burnishing tool 100 can handle, can be corrected by providing a reamer edge 153 on the shuttle 132, as shown in FIG. 6, between the radially outer portion of the second end surface 140 to the cylindrical guide surface 154. The reamer edges 153 will remove material from the inside of the pipe so that the pipe will slip over the guide surface 154.

The burnishing operation is performed by the burnishing grooves 144 and 146 described above. Burnishing and cleaning occurs simultaneously. However, the cleaning operation is generally necessary only when the pipes are to be connected to a coupler by solder. Many pipes are not connected together by solder, but must have sharp edges and burrs removed. An example of pipe that does not require cleaning is electrical conduit pipe. However, the removal of burrs and sharp edges from conduit is critical to ensure that the insulation encasing electrical wires is not damaged when the wires are pulled through the conduit.

Figure 11:
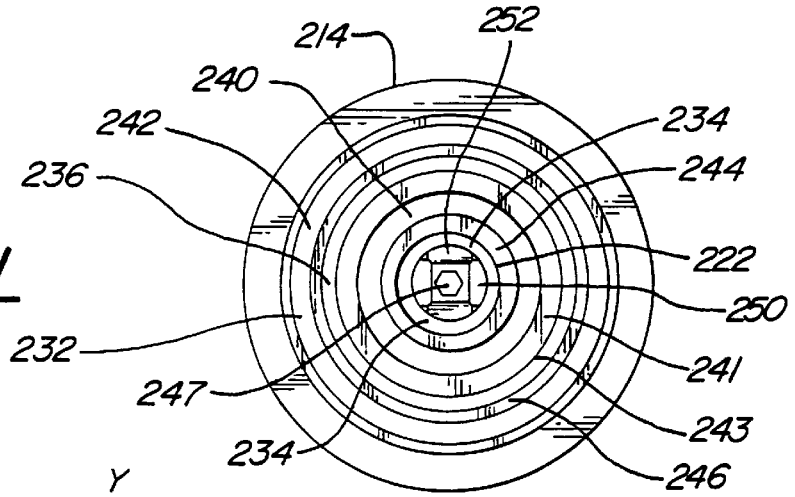
FIG. 11 is an end view of the burnishing tool of FIG. 9.
Figure 10:
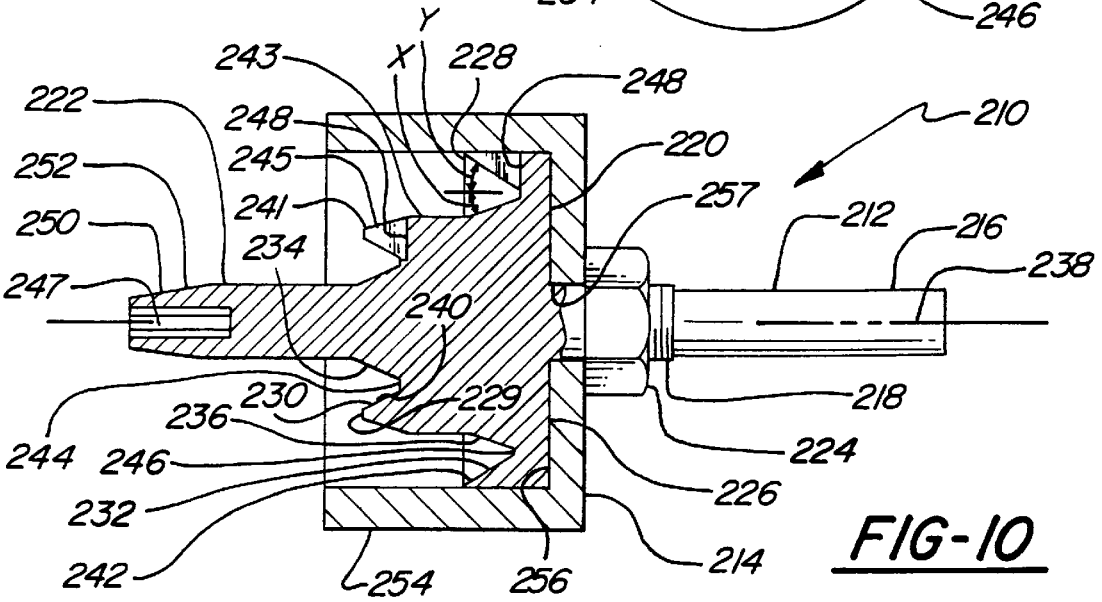
FIG. 10 is a cross sectional view of a separate pipe end burnishing tool internal pipe reamers.

To perform the burnishing operation on pipes that do not require cleaning, a burnishing tool 210 that is separate from the pipe cleaner 100 is provided. The burnishing tool 210 as shown in FIGS. 10 and 11 includes a tool member 212 and a cover 214. The tool member 212 includes a shank 216, a threaded section 218, a burnishing disk 220 and an integral pipe guide 222. The shank 216 is received within the chuck of an electric drill that rotates the tool 210 at a high speed. The threaded section 218 received a nut 224 that clamps the bottom of the cup-shaped cover to the surface 226 of the burnishing disk 220. The burnishing disk 220 has a surface 228 with an outer circular groove 232 and a surface 229 with an inner circular groove 230. The inner walls 234 and 236 of both circular grooves 230 and 232 are conical surfaces that extend at an angle of about 15 degrees, plus or minus 5 degrees from the axis 238 of the tool member 212. The outer walls 240 and 242 of both circular grooves 230 and 232 are conical surfaces that extend at an angle Y of between about 17 degrees and about 47 degrees from the axis 238 of the tool member 212. A radially extending concave surface 244 joins the inner wall 234 to the outer wall 240 of the inner groove 230. A radially extending concave surface 246 joins the inner wall 236 to the outer wall 242 of the outer groove 232. The end of the pipe which is being burnished by the burnishing tool 210 does not normally contact the radially extending surfaces 244 or 246. If the angle X is less than about 10 degrees, and the angle Y is less than about 17 degrees, the pipe being burnished will tend to lock in the groove 230 or 232 and rotate with the tool 210. If the angle X is more than about 20 degrees, and the angle Y is more than about 47 degrees, removal or burrs and sharp edges is slow and somewhat ineffective.

The circular, burnishing grooves 230 and 232 are axially offset from each other along the axis 238. The axial separation of the burnishing grooves provide space for a conical reamer section 241 and a cylindrical pipe guide section 243 between the small diameter burnishing groove 230 and the large diameter burnishing groove 232. A tool driver bore 247 is formed in the end of the pipe guide 222. A tool such as a power driver screw driver can be inserted into the bore 247. As shown, the bore 247 can accept a hexagon shaped tool shank. With the bore 247, the electric drill that rotates the burnishing tool 210 can also drive a tool such as a screw driver while the burnishing tool is still secured within the drill chuck.

Axial flutes 248 may be cut into the burnishing disk 220 to allow loose material to escape. Burnishing does not normally remove significant quantities of material. Due to the burrs that may be on the end of a pipe that has been cut, some material may be removed from the pipe during burnishing.

The internal pipe guide 222 extends into the end of a small diameter pipe during burnishing, and guides that pipe into the inner circular groove 230. A reamer portion 250 of the pipe guide enters the pipe first. Rotation of the tool 210 by an electric drill will result in the reamer portion 250 enlarging and reshaping the end of a pipe so that it will slide over the cylindrical pipe guide 222. As shown, the reamer portion 250 is the shape of a truncated pyramid with four flat surfaces 252. The ream section 241 performs the enlarging and reshaping function for pipes that fit in the outer burnishing grooves 232.

The cover 214 is a cup-shaped member that is preferably a molded plastic. The plastic material is a strong UHMW material with a low coefficient of friction or some other material with similar properties. The cover 214 has a tubular skirt 254 and a flat bottom wall 256. A central aperture 257 in the bottom wall 256 receives the shank 216 and the threaded section 218. The tubular skirt 254 and the pipe guide section 243 guide large diameter pipes into the outer circular groove 232 to be burnished.

The pipe cleaner 100 and burnishing tool 110 can, for example, be sized for ½ inch and ¾ inch pipe. They can also be sized for ¾ inch pipe and 1 inch pipe. Metric sized pipes as well as pipes with different wall thicknesses can be burnished and also cleaned. The largest diameter pipe or the smallest diameter pipe that can be handled has not been determined.

The burnishing tool 210 can, as indicated above, be sized and used to burnish the ends of pipes with a large range of sizes. However, for the burnishing tool 210 to work properly on pipes, the end surface of the pipe should be in a plane that is at a right angle to the long axis of the pipe. The smaller the diameter of the pipe, the closer the cut end surface must be to perpendicular to the axis of the pipe.

Figure 9:
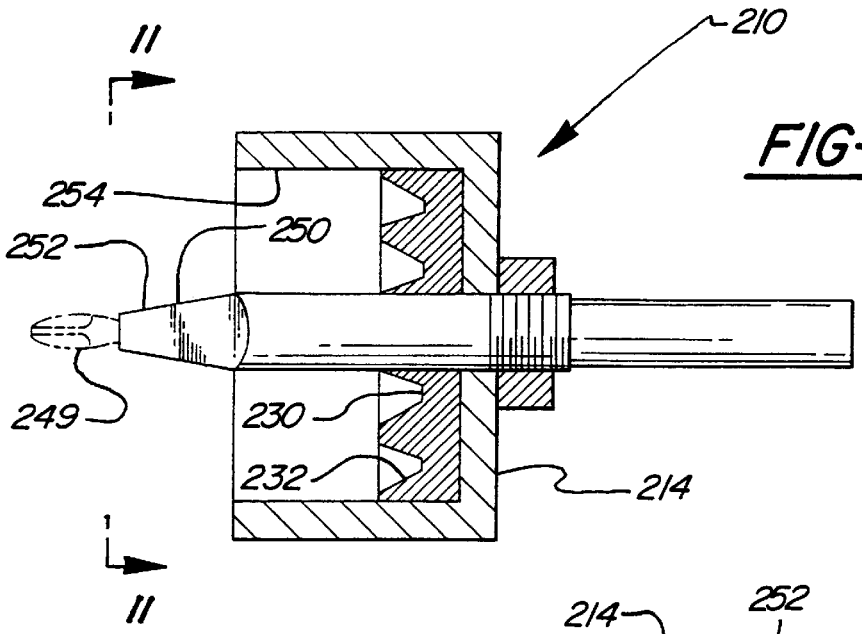
FIG. 9 is a cross sectional view of a separate pipe end burnishing tool.

The burnishing tool 210 shown in FIG. 9 is identical to the tool shown in FIGS. 10 and 11 except that the burnishing grooves 230 and 232 are not axially spaced apart. The burnishing grooves are in radial alignment with each other. With this arrangement there is no conical reamer section 241 for larger diameter pipe. A pipe guide is provided by the skirt 254 of the cover 214 because the pipe guide section 243 for larger diameter pipe is also eliminated. When burnishing the end of a pipe that has an inside diameter, that is the same as the nominal inside diameter, there is no need to ream the inside and the burnishing tool 210 shown in FIG. 9 is satisfactory.

Figure 12:
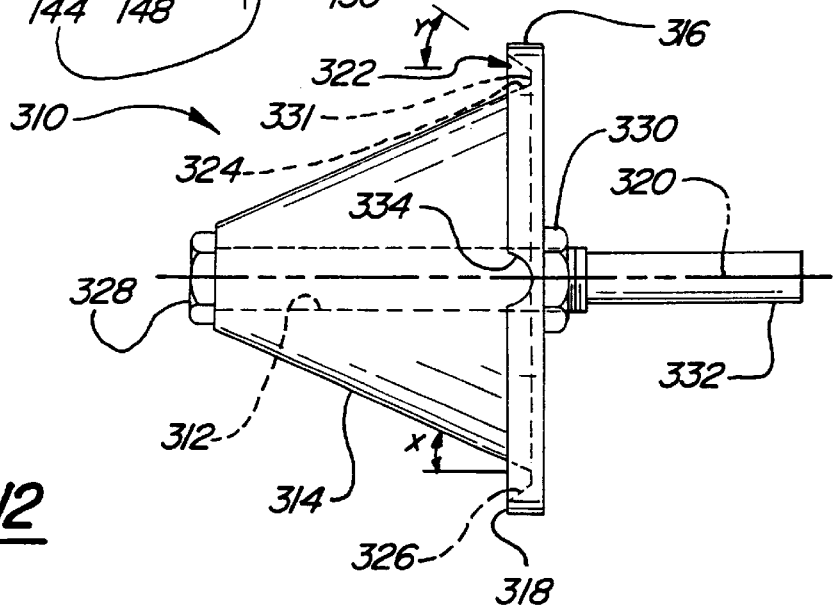
FIG. 12 is a side view of a separate pipe end burnishing tool.

The burnishing tool 310 shown in FIG. 12 can be used to burnish the ends of the pipes that are in a plane that is a number of degrees from perpendicular to the central axis of the pipe. The cut ends of electrical conduit pipe, that is more than one inch in diameter, are frequently in planes that are up to 15 degrees from perpendicular to the pipes center line.

The burnishing tool 310 has a central bore 312, a conical portion 314, and a flange 316 that extends radially outward from the large diameter end of the conical portion 314. The flange 316 has a surface 318 that faces toward the small diameter end of the conical portion 314 and that is in a plane that is perpendicular to the axis 320 of the central bore 312. A circular V-shaped groove 322 is formed in the surface 318. The inner wall 324 of the inner groove 322 is a conical surface that extends at an angle X of about 15 degrees, plus or minus 5 degrees, to the axis 320. The outer wall 326 of the groove 322 is a conical surface that extends at an angle Y of about 27 degrees, plus or minus 10 degrees, to the axis 320. A concave surface 331 extends radially from the inner wall 324 to the outer wall 326. A chip dropout passage or flute 334 is provided in the outer wall 326 of the V-shaped groove 322. A bolt 328 is inserted into the central bore 312 and is secured in place by a nut 330. The free end 332 of the bolt 328 that extends outward from the nut 330 is clamped in the chuck of an electric drill during use.

The conical portion 314 guides the end of a pipe into the groove 322 and permits the burnishing tool 310 to move into alignment with the pipe end surface even if the pipe is cut in a plane that is up to 15 degrees from perpendicular to the axis 320.

The combination pipe cleaner and burnishing tool 400, shown in FIGS. 4 and 5 functions about the same as the combination pipe cleaner and burnishing tool 100 described above, but has different structure. The different structure reduces the length of the pipe cleaner and burnishing tool 400, reduces the weight and improves reliability. The tool 400 includes a tubular barrel 402 with a closed end 404 and an open end 406. The closed end 404 has a centered bore 408. A pair of brush lever slots 410 and a pair of brush pad guide slots 412 are formed in opposite sides of the tubular barrel 402. The brush lever slots 110 extend from a position adjacent to the closed end 404 to a position in the center portion between the closed end 404 and the open end 406. The brush pad guide slots 412 join the brush lever slots 410 in the center portion of the tubular barrel 402 and extend through the end surface 414 on the open end 406. Brush lever pin supports 416 are provided on each side of each brush lever slot 410 adjacent to the brush pad guide slots 412. Brush lever pin bores are provided in the brush lever pin supports 416 that are identical to pin bores 118 in brush lever pin supports 116 shown in FIGS. 7 and 8. A shuttle key 420 is also formed inside the tubular barrel 402. The key 420 is preferably integral with the tubular barrel 402 and parallel to the long axis 421 of the barrel, but could also be a separate key if desired.

The shuttle guide 422 has a shuttle guide portion 426, a threaded portion 428 and a small diameter end portion 430 that is clamped in the chuck of an electric drill during use.

The shuttle 432 is a cylindrical member with a central bore 434. The central bore 434 is open at the first end 435 of the shuttle 432 and closed at the second end 437. The first end 435 has a first arcuate cam surface 436. The second end 437 has a plurality of flat surfaces 438 in planes that intersect the long axis 421 of the shuttle 432 and the tubular barrel 402. Reamer edge surfaces 440 are formed at the junction of the flat surfaces 438. A cylindrical small diameter pipe guide 442 extends axially from the reamer edge surfaces 440 to the small diameter pipe end surface burnishing groove 444. A large diameter pipe conical insider reamer surface 441 extends axially toward the first end 435 from the open end of the burnishing groove 444 to the large diameter pipe cylindrical pipe guide 443. The cylindrical pipe guide 443 extends axially toward the first end 435 to the large diameter pipe end surface burnishing groove 446.

The burnishing grooves 444 and 446 have a generally V-shaped cross section with a radially inner wall 448 extending at an angle X of about 15 degrees, plus or minus 5 degrees, from the axis of the central bore 421 and the radially outer wall 450 extending at an angle Y of about 27 degrees, plus or minus 10 degrees from the axis of the central bore. These burnishing grooves 444 and 446 are identical to the burnishing grooves 144 and 146 shown in FIG. 6. The outer burnishing groove 446 is in a surface 452 that is axially spaced from the inner groove 444 toward the cam surface 436 and the first end 435. The axial spacing provides space for the insider reamer surface 441 and the cylindrical pipe guide 443 for a larger diameter pipe. The outer burnishing groove 446 has a generally V-shaped cross section with a radially inner wall 451 extending at an angle X from the axis 421 of the central bore and a radially outer wall 453 extending at an angle Y from the axis of the central bore. The angles X and Y are the same for both of the grooves 444 and 446. These angles X and Y are the same as corresponding angles shown in FIG. 6. A concave surface 455 at the based of each V-shaped groove 444 or 446 joins the inner and outer walls of the V-shaped grooves 444 and 446.

Flat surfaces 454 and 456 are formed on the shuttle 432. These flat surfaces are parallel to the long axis 421 and extend from arcuate cam surfaces 457 and 459 toward the closed second end 437 of the shuttle 432.

A washer 461 slides over the end portion 430 and threaded portion 428 of the shuttling guide 422. The small diameter end portion 430 of the shuttle guide 422 is inserted into the open end 406 of the tubular barrel 402 and through the centered bore 408. A second washer 463 and a nut 465 are placed on the threaded portion 428 of the shuttle guide 422 and clamp the guide to the closed end 404 of the barrel 402.

A compression spring 458 is inserted into the central bore 434 of the shuttle 432. The shuttle 432 is then inserted into the open end 406 of the tubular barrel 402 and onto the shuttle guide portion 426 of the guide 422. A guide slot 460 in the shuttle 432 receives the shuttle key 420. The key 420 prevents the shuttle 432 from rotating, about the axis 421, relative to the barrel 402.

Brush levers 466 are inserted into each of the brush lever slots 410 with a first cam surface 468 adjacent to the cam surface 436 on the first end 435 of the shuttle 432 and a second cam surface 470 adjacent to one of the second arcuate cam surfaces 457 or 459 on the shuttle. The second cam surface 470 on the brush levers 466 retain the shuttle 432 in the barrel 402. A brush lever pin 472 is inserted into the brush lever pin bores 118 for each brush lever 466 and through a bore 474 through each of the brush levers. This pivotally secures each brush lever 466 to the tubular barrel 402 and retains the shuttle 432 within the tubular barrel. A brush pad 476 is inserted into each brush pad guide slot 412 and connected to the brush arm 478 of an adjacent brush lever 466. The brush pads 476 may be connected to the brush lever 466 by a push pin 480 that passes through a bore through the brush lever or by another suitable connector.

The brush pads 476 are essentially the same as the brush pads 176 described above. A pipe cleaner 400 for relatively large diameter pipes may be provided with additional brush levers 466 and brush pads 476.

A pipe guide end cap 484 has a cylindrical portion 486 with an outside surface that is received within the open end 406 of the tubular barrel 402. An integral flange 488 on the end cap 484 is clamped to the open end 406 of the tubular barrel 402 by mechanical fasteners 190. A bore 492 through the end cap 484 is slightly larger than the outside diameter of the largest pipe that is to be cleaned and acts as a pipe guide. Brush pad guide slots 493 through the cylindrical portions 486 line up with the brush pad guide slots 412 and guide the brush pads 476 during their movement toward and away from the flat surfaces 454 and 456 on the shuttle 432. The flat surfaces 454 and 456 on the shuttle 432 allow the brush pads 476 to move in to and out of contact, with a pipe to be cleaned, without contacting the shuttle 432 as explained above in connection with the pipe cleaner 100.

The pipe cleaner and burnishing tool 400 operates substantially the same as the pipe cleaner and burnishing tool 100 described above.

The tubular barrel 402 shown in FIGS. 4 and 5 is substantially identical to the tubular barrel 102 shown in FIGS. 3, 7, and 8. The space of the end of the slot 110 to the closed end 104 must be increased to provide space for the spring 158. Since the pipe cleaner 400 shown in FIGS. 4 and 5 has an internally mounted spring 458, space for a spring need not be provided between the shuttle 432 and the closed end 404.

A pipe internal reamer 500 is shown in FIG. 13. The reamer includes a base flange 502, a large diameter conical section 504 and a small diameter conical section 506. A central bore 508 is provided in the center of the reamer 500. A bolt 510 is held in the central bore 508 by a nut 512. The free end 514 of the bolt 510 is clamped in the chuck of a drill to rotate the reamer about an axis 516. The section 506 is connected to the section 504 by a flat surface 520 that is in a plane that is perpendicular to the axis 516. The flat surface 522 of the flange 502 is also perpendicular to the axis 516. Grooves for burnishing end surfaces of pipes are not required when using the reamer 500 on small diameter copper pipe.

Axially extending grooves or flutes 524 and 526 are cut into the conical sections 504 and 506 to catch chips and to provide reamer edge surfaces 528 and 530. The side of the flutes 524 and 526 which form the reamer edge surfaces 528 and 530 depends upon the direction of rotation of the reamer 500. The rate of material removal by the reamer can be increased by grinding about five thousands of an inch of material from the conical surfaces 532 and 534 with the exception of a narrow strip adjacent to the reamer edge surfaces 528 and 530.

The disclosed embodiment is representative of a presently preferred form of the invention, but is intended to be illustrative rather than definitive thereof. The invention is defined in the claims.

I claim:

1. A pipe cleaner attachment, for a drill comprising a housing;

a shaft secured to the housing and adapted to be rotated about an axis by the drill;

a shuttle restrained by the housing to movement parallel to the axis;

a pipe inlet in the housing that exposes one end of the shuttle and forms a pipe inlet passage;

a brush lever pivotally attached to the housing;

a pad carrying an abrasive, pivotally attached to an end of the brush lever adjacent to a pipe inlet; and a cam surface on the shuttle that contacts the cam surface on the brush lever in response to axial movement of the shuttle away from the pipe inlet in the housing and moves the pad toward the pipe inlet passage.

2. A pipe cleaner attachment as set forth in claim 1 including a second brush lever pivotally attached to the housing;

a second pad carrying an abrasive attached to an end of the second brush lever; and a cam surface on the second brush lever that contacts the cam surface on the shuttle in response to axial movement of the shuttle away from the pipe inlet in the housing and moves the second pad toward the pipe inlet passage.

3. A pipe cleaner attachment as set forth in claim 1 including a reamer, carried by the housing, for reaming inside surfaces at the end of a pipe.

4. A pipe cleaner attachment as set forth in claim 3 including a burnishing groove on the shuttle that engages a pipe and removes burrs from an end surface of the pipe.

5. A pipe cleaner attachment as set forth in claim 1 including a burnishing groove on the shuttle in axial alignment with the pipe passage that is operable to engage a pipe in the pipe passage and remove burrs on an end surface of the pipe.

6. A pipe cleaner attachment as set forth in claim 1 including a reamer, carried by the shuttle, for reaming inside surfaces at the end of a pipe.

7. A method of cleaning an end of a pipe employing a pipe cleaner attachment attached to a drill comprising:

rotating the pipe cleaner about an axis of rotation;

inserting an end of the pipe into a pipe passage in the pipe cleaner attachment;

forcing the pipe into the pipe cleaner to move a shuttle parallel to the axis of rotation of the pipe cleaner attachment;

camming a brush lever about a brush lever pivot axis;

moving a pad carrying an abrasive, that is attached to the brush lever, into contact with the end of the pipe;

holding the pipe while the abrasive pad cleans the outer pipe surface adjacent to the pipe end; and removing the pipe from the pipe passage in the pipe cleaner attachment.

* * * * *